United States Patent [19]

Seki

[11] 4,271,682

[45] Jun. 9, 1981

[54] COOLING APPARATUS FOR VISCOUS LIQUIDS

[75] Inventor: Kunimichi Seki, Tokyo, Japan

[73] Assignee: Hiroshi Takeuchi, Tokyo, Japan

[21] Appl. No.: 85,710

[22] Filed: Oct. 17, 1979

[30] Foreign Application Priority Data

Oct. 27, 1978 [JP] Japan ..... 53-131709

[51] Int. Cl.[3] ..... F25C 1/14

[52] U.S. Cl. ..... 62/354; 62/381

[58] Field of Search ..... 62/354, 381

[56] References Cited

U.S. PATENT DOCUMENTS 2,677,942 5/1954 Schott et al. ..... 62/381

4,059,047 11/1977 Sollich ..... 62/354

*Primary Examiner*—Ronald C. Capossela

*Attorney, Agent, or Firm*—Toren, McGeady and Stanger

[57] ABSTRACT

A passage to supply the coolant and impellers having scraper vanes extending toward the surface of said passage are arranged in proximal relation to each other in a space for housing the liquid to be cooled. At least one of the coolant passage and the impeller is made movable in relation to the other. By the relative movement of the passage and the impeller, the motion of forcibly removing the cooled liquid from the heat exchange portion of the passage surface and the motion of supplying the high temperature liquid to the said heat exchange portion are repeated.

3 Claims, 5 Drawing Figures

COOLING APPARATUS FOR VISCOUS LIQUIDS

BACKGROUND OF THE INVENTION

The present invention concerns an apparatus for continuously and efficiently cooling liquids with a high viscosity such as the oil used in oil pressure equipments and apparatus, and lubricants and quenching oil for precision machineries.

Generally speaking, the precision and performance of the oil used in operating oil pressure equipments, lubricants or quenching oil for precision machineries become excessively deteriorated as the temperature rises during use, and therefore they must be cooled. However, when an ordinary method of cooling is employed, a highly viscous oily film becomes adhered securely to the surface of the cooling device which contacts the oil being cooled. Such efforts as creating irregularities on the surface of the cooling device are not sufficiently effective in causing turbulences, and the cooling efficiency becomes extremely inferior. Accordingly, a much wider heat exchange area than that required for cooling low viscosity liquid such as the water becomes needed, thereby increasing the volume and the cost of the apparatus.

The present invention was contrived in view of the difficulties mentioned above, and aims to provide a cooling device for viscous liquids which repeats the motion of scraping and removing highly viscous liquids cooled by the coolant, and the motion of replacing high temperature oil on the coolant-contacting surface in order to efficiently and continuously cool the highly viscous liquids.

DETAILED DESCRIPTION OF THE INVENTION

Figure 1:
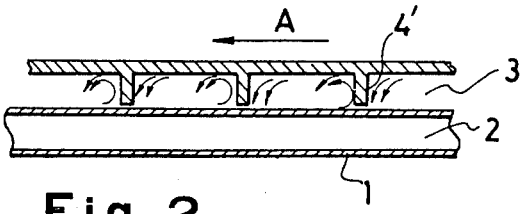
FIG. 1 is a diagram to illustrate the cooling principle of the present invention.
Figure 2:
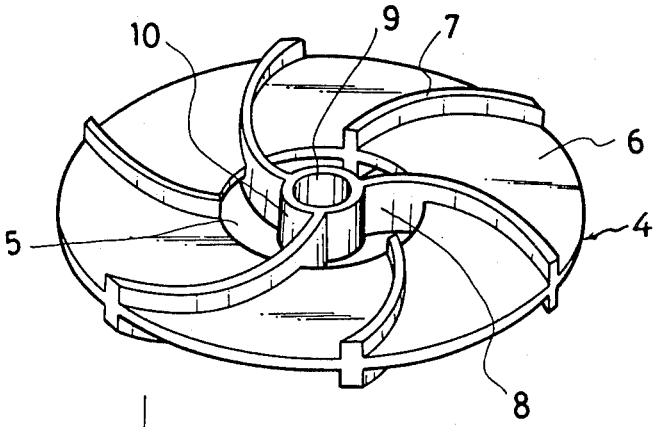
FIG. 2, is a perspective view of an impeller in accordance with the present invention.
Figure 3:
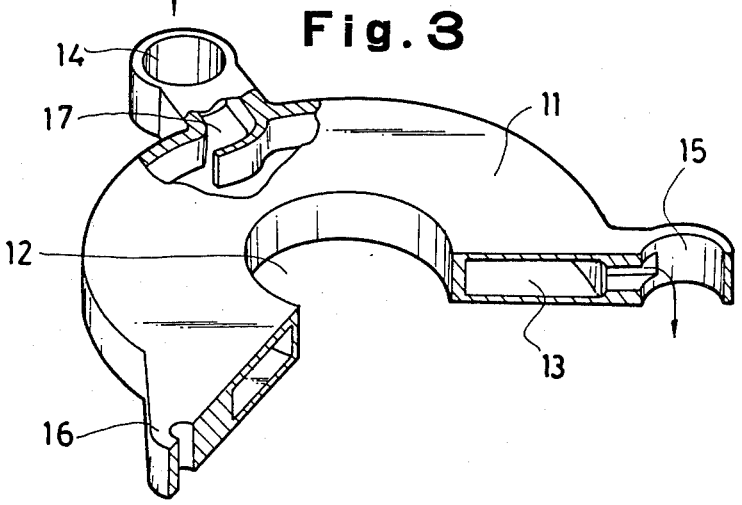
FIG. 3 is a perspective view showing in cross section a portion of the water jacket.

The present invention is now explained in further detail reference being made to the attached drawings. FIG. 1 is an explanatory diagram to illustrate the principle of the present invention wherein the reference number 1 denotes a cooling device, 2 the coolant, 3 a highly viscous liquid which is to be cooled, and 4 vanes. When the coolant 2 such as the water is passed to the cooling device 1 and the highly viscous liquid 3 such as oil is contacted with the surface thereof, the surface of the cooling device 1 becomes covered with a highly viscous film. As the vanes 4 adjacent to the surface of the cooling device 1 are moved toward the direction of the arrow A, the cold oily film becomes peeled, and is replaced by the high temperature oil. The present invention was contrived based on the observations made of this phenomenon, and is now explained in further detail referring to one embodiment thereof. By providing a plurality of scraper vanes 4, the above mentioned cooling operation is repeated, and by constructing the scraper vanes 4 in a circular impeller and by placing an annular water jacket forming a passage for the coolant adjacent to the said impeller and rotating the impeller alone, the cooled oil is sent away toward the outer periphery by the action of the centrifugal pump, thereby improving the cooling efficiency.

An embodiment of the present invention is now explained further based on FIGS. 2 to 5 wherein the scraper vanes 4 (hereinafter referred to as the impeller) are provided with a plurality of spiral scraper plates 7, 7 . . . (six in the figure) on the both sides of a circular plate 6 having a hole 5 in its center. Each of alternating spiral plates 7, 7 . . . has an extension 8 extending toward the center of the plate, and is provided with a shaft boss 10 having a shaft hole 9 at the tip of said extension 8. The reference number 11 denotes an annular water jacket through the center of which passes the impeller shaft 18 about which reference will be made later, and having a hole 12 which also acts as a passage for the oil being cooled. There is further provided a hollow water jacket section 13 in the annular member, whereas a cooling water inlet 14, an outlet 15 and a lug 16 are provided at an interval of about 120° on the outer periphery of the annular member. The inlet 14 for the cooling water and the water jacket 13 are connected to each other by a jet port 17. In this case, the jet port 17 is so adapted to circulate the cooling water in the circumferential direction of the water jacket 11.

Figure 4:
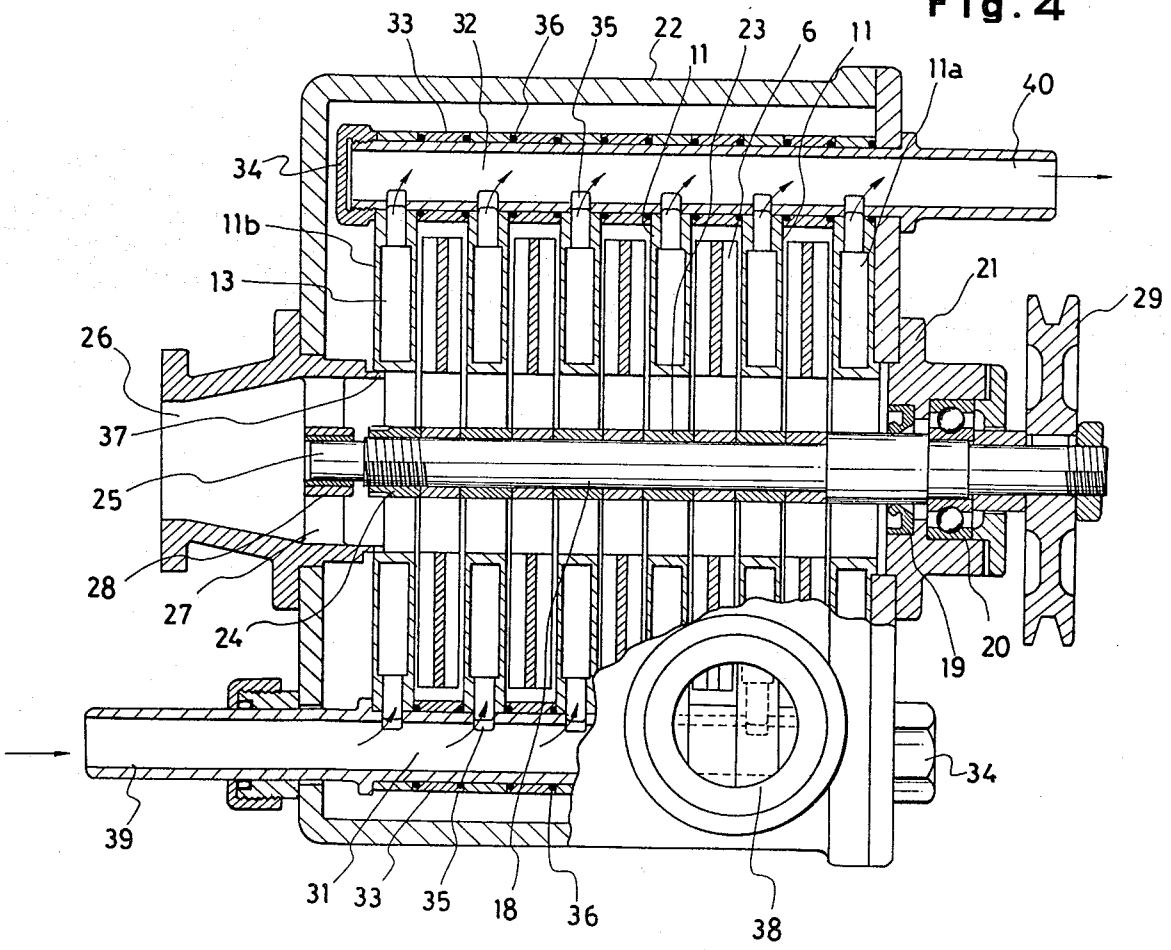
FIG. 4 is a vertical cross sectional view of the apparatus in accordance with the present invention.
Figure 5:
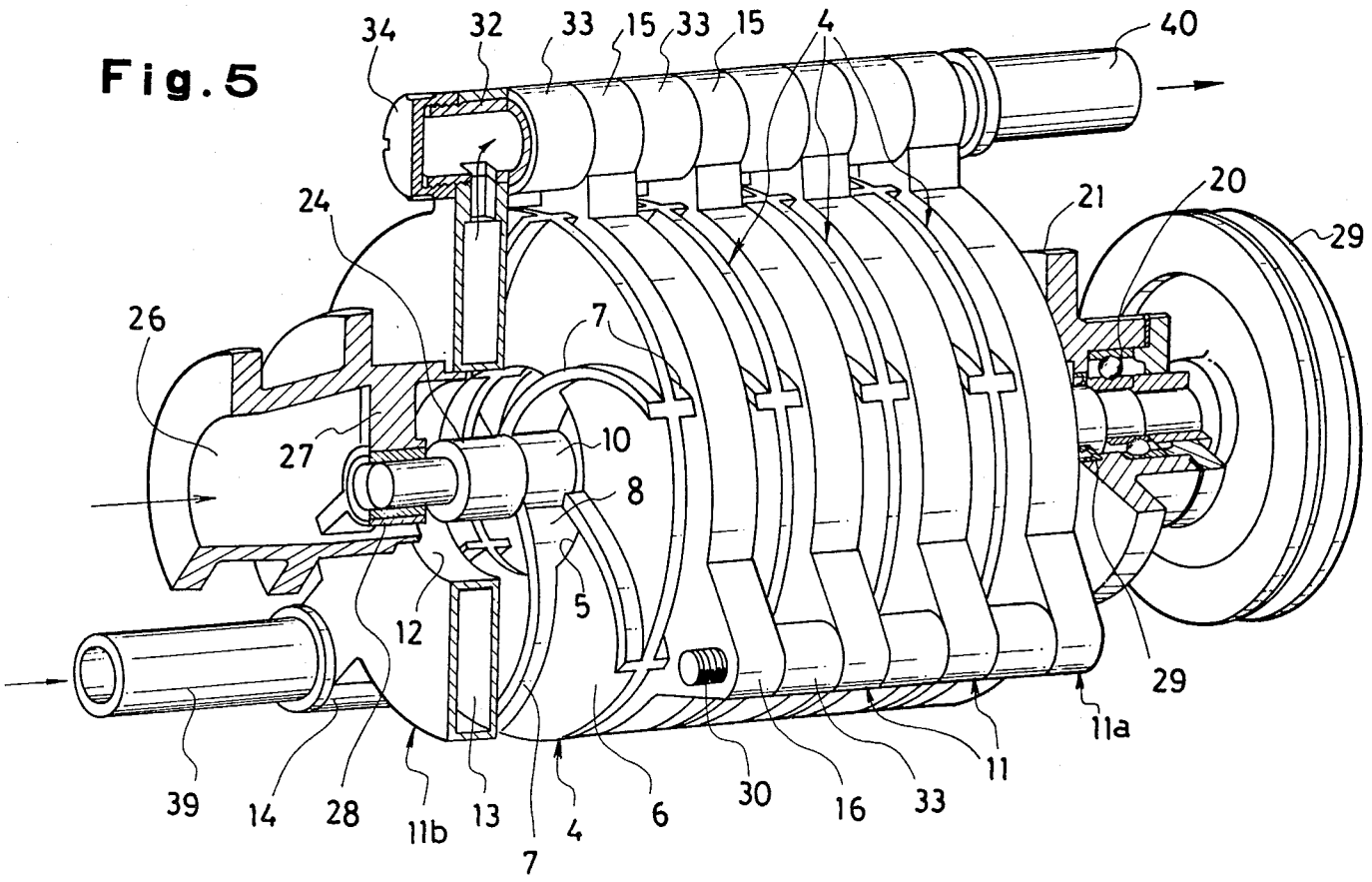
FIG. 5 is a perspective view of an embodiment of the present invention from which a portion has been cut away.

FIGS. 4 and 5 show a cooling device comprising the said impellers 4 and the water jackets 11 combined in plural layers; the impeller shaft 18 is closed axially by the oil seal 19 and is retained in a case body 22 by the bearing box 21 incorporating a ball bearing 20. The impeller shaft 18 is also provided with a plural number of said impellers 4 suitably spaced apart by a spacer collar 23, and is fixed by a clamp screw 24 to rotate with the impeller shaft 18. One end 25 of the impeller shaft 18 is supported rotatably by the bearing 28 provided on a radial arm 27 projecting toward the inside of an oil inlet port 26 bored on the case 22, whereas at the other is provided a drive pulley 29 which is driven by a driving source (not shown) to rotate the impeller shaft 18.

On the other hand, there are arranged the water jackets 11 between said impellers 4 coaxially with respective impellers 4 but not contacting therewith. The water jacket 11*a* on the driving side is fixed inside the case 22, whereas the other water jackets 11, 11 . . . positioned alternately with the impellers 4 in a sequence are fixed to the said water jacket 11*a* by placing spacers 33 between the lug 16, the water inlet port 31 and the outlet port 32 to keep them apart by predetermined distances and by tightening the bolt 30 placed through the lug 16 by a nut (not shown). One end of the inlet port 31 and that of the outlet port 32 for the cooling water are respectively tightened by a cap nut 34 which also acts as a blank cap. There is bored a hole 35 for passing the water to the cooling water pipes 31 and 32 to correspond to the distance between the water jackets 11, and the spacers 33 are provided with a packing 36 for water seal. Inside the hole 12 of the water jacket 11*b* at the final end of the layers is inserted shallowly the end 37 of the inner cylinder of the inlet port 26 for the oil being cooled, whereas there is provided an outlet port 38 for the oil being cooled at the opposite end of the said inlet port 26 of the case 22.

The operational mode of the cooling apparatus in accordance with the present invention is now explained.

To perform cooling, the inlet port 26 and the outlet port 38 are connected to an oil circulating pass or an oil tank to fill the oil passage inside the case 22 with oil, and then the cooling water is passed through the water inlet 39 inside the water jacket member 13 of the respective water jackets 11 to be exhausted through the outlet 40 or to be circulated via the cooling tower. When the drive pulley 29 is rotated, the oil cooled upon the surface of the water jackets 11 is scraped off by the scraper vanes 7 of the impeller 4 and replaced by the hot oil to be cooled. By the centrifugal force of the rotating impeller 4, the cooled oil is pushed toward the outer peripheral direction and exhausted through the outlet 38 so that the new high temperature oil is suctioned into the oil passage through the inlet 26, the said high temperature oil reaching between the respective water jackets 11 via the inner peripheral holes 12 and 5 of the water jackets 11 and the impellers 4 to be cooled by the heat exchange with the cooling water.

In the above mentioned embodiment, the scraper vanes 4 are rotated against the water jacket 11, but it is possible to rotate the water jacket 11 against the vanes 5 and also to form the water jackets and the vanes in a coaxial cylindrical relation and rotate one or the other to obtain a similar effect. Other fluids than the water may be used as a coolant.

As explained above, the cooling device according to the present invention is so constructed that the passage for circulating coolant and the vanes to scrap off the liquid being cooled from the heat exchange surface of the coolant passage are provided in proximal relation to each other and also that one of these passages and the vanes are formed movably relative to the surface of the other. Therefore, it is possible to miniaturize the apparatus to simultaneously replace the forcibly removed cooled highly viscous liquid with the high temperature oil on the surface of the coolant passage, thereby enabling an efficient cooling of the highly viscous liquid. As the exhaust pressure by the centrifugal force of the vanes act as the circulating pump for the oil without modification, the cooling apparatus is quite useful as a device provided with double functions of cooling and circulating pump.

What we claim is:

1. Cooling apparatus for viscous liquids comprising: a fixed casing having a viscous liquid inlet and a viscous liquid outlet to enable a viscous liquid to be cooled to flow through the interior of said casing; a shaft rotatably mounted on said casing and extending through the interior thereof; a plurality of generally annularly shaped impeller discs affixed to said shaft for rotation therewith and axially spaced apart along the length of said shaft; coolant chamber means sealed in fluid-tight relationship relative to the interior of said casing for passing a coolant fluid through said casing in heat-transfer relationship with said viscous liquid; said coolant chamber means comprising a plurality of coolant fluid chambers each arranged between a pair of said impeller discs, each of said coolant fluid chambers being defined between a pair of radially extending walls having planar outer surfaces, with the planar outer surfaces of adjacent ones of said coolant fluid chambers having one of said impeller discs radially extending therebetween; and a plurality of scraper blades formed on each of said impeller discs and affixed to said impeller discs for rotation therewith, said scraper blades being arranged to extend radially from said shaft and to protrude axially to both sides of said impeller discs into at least close proximity with said planar outer surfaces of said coolant fluid chamber walls; said scraper blades and said impeller discs being joined together as a unitary member and immovable relative to each other.

2. Apparatus according to claim 1 wherein said scraper blades extend radially from said shaft with a curved configuration, said impeller discs thereby acting to effect operation of said cooling apparatus as a centrifugal pump.

3. Apparatus according to claim 1 wherein said impeller discs are formed with a central opening surrounding said shaft and wherein each of said discs is formed with a plurality of said scraper blades extending radially inwardly of said opening and affixed upon said shaft.

* * * * *